US009711898B2

(12) United States Patent
Zabielski

(10) Patent No.: US 9,711,898 B2
(45) Date of Patent: Jul. 18, 2017

(54) ELECTRICAL CONNECTOR SYSTEM WITH LATERALLY PROTRUDING RELEASING ARM

(71) Applicant: Delphi Technologies, Inc., Troy, MI (US)

(72) Inventor: Pawel Zabielski, Cracow (PL)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/064,695

(22) Filed: Mar. 9, 2016

(65) Prior Publication Data

US 2016/0294117 A1 Oct. 6, 2016

(30) Foreign Application Priority Data

Mar. 30, 2015 (EP) ..... 15161758

(51) Int. Cl.

| | |
|---|---|
| ***H01R 13/625*** | (2006.01) |
| ***H01R 13/639*** | (2006.01) |
| ***H01R 13/424*** | (2006.01) |
| *H01R 12/75* | (2011.01) |
| *H01R 13/422* | (2006.01) |

(52) U.S. Cl.

CPC ..... *H01R 13/639* (2013.01); *H01R 13/424* (2013.01); *H01R 12/75* (2013.01); *H01R 13/4223* (2013.01)

(58) Field of Classification Search

CPC ..... H01R 4/28; H01R 4/48; H01R 4/4836; H01R 12/78; H01R 12/79; H01R 12/81; H01R 13/639; H01R 13/436; H01R 13/4361; H01R 13/4362; H01R 11/282

USPC ..... 439/347, 152, 153, 345, 346

See application file for complete search history.

(56) References Cited

U.S. PATENT DOCUMENTS

| | | | | |
|---|---|---|---|---|
| 5,356,302 | A * | 10/1994 | Inoue | H01R 31/085 439/189 |
| 7,287,994 | B1 * | 10/2007 | Liao | H01R 13/6273 439/172 |
| 7,530,829 | B2 * | 5/2009 | Yuan | H01R 13/639 439/232 |
| 9,059,542 | B2 * | 6/2015 | Oh | H01R 4/48 |
| 9,077,114 | B2 * | 7/2015 | Oh | H01R 4/48 |
| 9,184,515 | B1 * | 11/2015 | Freakes | H01R 4/2433 |
| 2009/0311918 | A1 | 12/2009 | Martin | |

FOREIGN PATENT DOCUMENTS

| | | | |
|---|---|---|---|
| DE | 4205974 | C1 | 6/1993 |
| DE | 19756905 | A1 | 6/1999 |
| EP | 108608 | A1 | 8/1986 |
| EP | 608863 | A2 | 4/1998 |

* cited by examiner

*Primary Examiner* — Vanessa Girardi
(74) *Attorney, Agent, or Firm* — Robert J. Myers

(57) ABSTRACT

The invention relates to an electrical connector system including a terminal, configured to be conductively connected to a printed circuit board and a cavity body element. The cavity body element has a cavity and a primary locking member. The cavity is configured to receive the terminal. The cavity extends from a front end to a rear end of the cavity body element. The front end is arranged opposite of the rear end. The primary locking member is configured to lock the terminal. The primary locking member includes a releasing arm protruding through a lateral surface of the cavity body element.

13 Claims, 6 Drawing Sheets

ELECTRICAL CONNECTOR SYSTEM WITH LATERALLY PROTRUDING RELEASING ARM

CROSS-REFERENCE TO RELATED APPLICATION

This application claims the benefit under 35 U.S.C. §119 (a) of Patent Application No. 15161758.6 filed in the European Patent Office (EPO) on Mar. 30, 2015, the entire disclosure of which is hereby incorporated by reference.

TECHNICAL FIELD OF THE INVENTION

The invention relates to an electrical connector system and a method to assemble the electrical connector system, comprising at least one terminal, configured to be conductively connected to a printed circuit board (PCB) and at least one cavity body element comprising a primary locking member to lock the terminal in the cavity body element, wherein the primary locking member has a releasing arm, protruding through a lateral surface of the cavity body element.

BACKGROUND OF THE INVENTION

Electrical connector systems are known in the art. For providing electrical conductive connections between a cable/wire and a printed circuit board, typically the printed circuit board is provided with respective pins or terminals, and a corresponding terminal is arranged on the wire, such that a pluggable connection can be provided. In typical applications, such as in the field of automotive manufacturing, a plurality of cables/wires has to be connected to a printed circuit board that is for example part of a printed circuit board-based electrical center. Those electrical centers gather several electrical connections that may be pluggable. Thus, particularly if multiple cables have to be connected, the cables can be gathered together in a harness that is provided with a multi-terminal connector. The connectors are typically limited with regard to power supply characteristics, and therefore mainly used for the signal lines. Hence, for power supply connections additional connecting facilities are required and among others, bus bars, bolts, nuts and ring terminals are commonly used. Due to the use of multiple components, and due to the complex connection of nuts and ring terminals compared to pluggable connections, known solutions for connecting the harness and the power supply to a printed circuit board are expensive and time consuming.

To avoid the use of bus bars, bolts, nuts and ring terminals hardwired printed circuit boards are preferred, since the terminals of the cables/wires can be directly connected to the corresponding counter terminals of the PCB by plugging. Typically, the terminals of the cables/wires are fixedly locked by corresponding locking means provided on the PCB, when firstly connected to the corresponding counter terminal. The fix locking hinders the terminals from being released, when for example being wrongly connected or for maintenance reasons. In particular the releasing of the terminals is difficult, since the terminals are typically inserted into an inlet opening of a housing of the PCB and locked therein. When installed, the cable and respectively the corresponding terminal obscures the locking means, seen from the inlet opening. Further, the outlet opening, with which the terminal is connected to the PCB is obscured by the PCB. Thus, to release the connection between the terminal and the PCB, and to remove the terminal completely, either releasing tools such as screw drivers or the like have to be used, or the PCB has to be removed first. The use of releasing tools bears the risk of damaging the PCB due to misuse and slipping. Removing the PCB requires disconnecting the entire harness and is therefore time consuming and prone to damage or destroy the PCB and/or the terminals of the PCB.

Thus, there is a need in the art for connecting facilities for PCBs with improved handling characteristics, in particular improved connecting and releasing characteristics, and with a secure connection and preferably a reduced number of parts.

BRIEF SUMMARY OF THE INVENTION

The problems and drawbacks related to known connecting facilities for PCBs can be overcome with an electrical connector system and a method for assembling the electrical connector system described herein.

In particular, the problems and drawbacks can be overcome by an electrical connector system comprising: at least one terminal, configured to be conductively connected to a printed circuit board; and at least one cavity body element, comprising a cavity and at least one primary locking member, wherein the cavity is configured to receive the at least one terminal and extends from a front end to a rear end of the cavity body element, wherein the front end is arranged opposite of the rear end, and wherein the primary locking member is configured to lock the at least one terminal, and wherein the primary locking member comprises a releasing arm, protruding through a lateral surface of the cavity body element.

Providing a cavity body element for receiving at least one terminal allows the plugging of the terminal on the corresponding counter terminal of the PCB, and thus a fast and easy conductive connection that is suitable for transferring signals and/or power. The cavity body element may be designed to receive one terminal, however receiving multiple terminals is also possible. The cavity of the cavity body element may be shaped characteristically, so that only one specific type of terminal can be inserted. Thus the correct connection of a cable to the PCB can be achieved. Further, by locking the received terminal, a secure connection can be achieved, since the locking renders the terminal essentially immobile and prevents the terminal from being pulled out of the cavity.

By providing a primary locking member comprising a releasing arm, which arm protrudes through a lateral surface of the cavity body element, the locking of the terminal by means of the primary locking member can be released easily. No additional releasing tool may be required, since the releasing arm is operable from the side of the cavity body element. Thus, hardwired PCB's can be constructed with terminals that can be safely disassembled. Further the costs of the PCB-elements, such as electrical centers can be reduced since neither complex connectors are necessary, nor additional connecting facilities such as bolts, nuts and ring terminals.

The primary locking member may comprise a latching protrusion configured to latch a corresponding latching recess of the terminal, to prevent the terminal from being pulled out of the cavity. Providing a latching protrusion, and in particular a latched connection between the terminal and the cavity body element, will improve the connection, so that the connection can withstand higher tensile forces, compared to non-latched connections.

The locking of the primary locking member may be released manually without the need of a releasing tool. A manual releasing of the primary locking member facilitates the releasing process, since no additional tool is required. For example in a manufacturing process, an operator needs not to apply a particular tool, if the locking has to be released. Thus, maintenance and failure correction can be facilitated and accelerated. Further, by avoiding releasing tools, the risk of damaging the components, such as the PCB can be minimized.

The locking of the primary locking member may be released by pressing the protruding releasing arm. A simple pressing for releasing the locking of primary locking member allows a fast releasing. Further, since the releasing arm is a protruding releasing arm, the releasing is operated lateral of the cavity body element and thus the releasing mechanism offers a good accessibility.

The cavity body element may provide an audible sound, such as a clicking sound, when the primary locking member locks the terminal. The audible sound provides a feedback for the assembling operator, indicating that the terminal is locked safely in the cavity. Thus, the assembly of the electrical connector system becomes less error-prone.

The cavity body element may be integrally formed with a part of the housing, covering the printed circuit board. In many applications, in particular industrial and automotive applications, printed circuit boards are covered by a housing. Forming the cavity body element integrally with the housing further reduces the number of parts of the electrical connector system. Further, a reduced number of parts significantly reduces the assembly effort.

The electrical connector system may further comprise a secondary locking element, wherein the secondary locking element comprises at least one blocking portion assigned to the at least one primary locking member, to prevent an unintentional releasing of the primary locking member, when the secondary locking element is engaged. Providing a secondary locking element that prevents the releasing of the primary locking member additionally secures the locking of the terminal. In particular, since the releasing of the primary locking member can be prevented, the risk of an unintentional or accidental releasing can be significantly minimized. For example, if the electrical connector system is completely assembled and integrated in e.g. an engine compartment of a car, the primary locking member could be unintentionally released during further assembly steps, in or around the engine compartment. If the locking of the terminal is released, the terminal could be pulled out of the cavity. Thus the terminal and the PCB would be disconnected, and the functionality of the e.g. on-board electronics of the car could be distorted. By preventing the releasing of the primary locking member, the risk of an unintentional releasing is minimized.

The secondary locking element may further comprise at least one secondary locking member, configured to additionally lock the at least one terminal. Providing further locking members additionally secures the terminal. Further, in the case that one of the primary and/or secondary locking member should fail, the other locking member provides the locking of the terminal in the cavity body element. This redundant locking system is more secure than a single locking member.

The blocking portion of the secondary locking element may comprise a blocking surface that contacts an outwardly oriented surface of the primary locking member in an engaging position, to prevent an outwardly directed movement (i.e. away from the cavity body element), such as bending, of the primary locking member. Typically, the primary locking member is deflected by the terminal, when the terminal is inserted into its cavity. After having passed the primary locking member during insertion, the primary locking member moves back to its initial position, to lock the terminal. To release the locking, the primary locking member must be moved again outwardly, so that the terminal can pass. If the outwardly directed movement of the primary locking member is prevented, the primary locking member has to remain in its locking position, and thus the terminal cannot pass and also remains locked.

The secondary locking element may further comprise a laterally protruding arm that is arranged below the releasing arm of the primary locking element, seen from the front end of the cavity body element, providing an inlet opening for the terminal. The arm of the secondary locking element may support the blocking of the outwardly directed movement of the primary locking member by blocking a movement of the releasing arm.

The arm of the secondary locking element may provide at least one side wall that protrudes in direction of the releasing arm of the primary locking element in an assembled condition, so that the at least one side wall protects the releasing arm may be preferably guided by the releasing arm, that is received by the at least one side wall of the arm of the secondary locking element, along the releasing arm from a pre-position in an engaging position. In the pre-position, the secondary locking element may be arranged on the cavity body element, without blocking the primary locking member and/or without locking the terminal. In the engaging position, blocking and/or locking occurs.

The at least one secondary locking member of the secondary locking element may comprise a secondary latching protrusion, being configured to latch into or onto corresponding secondary latching recess of the terminal, to prevent the terminal from being pulled out of the cavity. Providing a latching protrusion, and in particular a latched connection between the terminal and the secondary locking element, improves the connection between the secondary locking element and the terminal, so that the connection can withstand higher tensile forces, compared to non-latched connections.

The secondary locking element may be arranged moveably on the cavity body element, such that the secondary locking element is movable form a pre-position into an engaging position, and wherein the at least one secondary locking member of the secondary locking element may be guided in a guidance groove, to guide the secondary locking element form the pre-position into the engaging position. Arranging the secondary locking element movable on the cavity body element allows a faster and facilitated assembly process. Providing a preassembled structure comprising the secondary locking element and the cavity body element, reduces the number of parts to be assembled in the assembly process. Thus costs and time can be reduced. Further, providing a guidance groove facilitates the movement of the secondary locking element from the pre-position in the engaging position. Thus the movement is less error-prone.

The secondary locking element may further comprise at least one latching hook configured to latch a corresponding latching recess, provided on a lateral surface of the cavity body element, to secure the secondary locking element in the engaging position. Additionally securing the secondary locking element in the engaging position reduces the risk of an unintentional releasing of the locking of the terminal in the cavity body element. Since the secondary locking element, when being in in the engaging position, prevents the primary locking member from being released, and the latching hooks prevent the secondary locking element from being moved back in the pre-position, out of the engaging position, a two-step securing mechanism is achieved.

Further, the problems and drawbacks can be overcome by a method to assemble the electrical connector system of any of the preceding claims, comprising the following steps: providing a printed circuit board having at least one counter-terminal; providing at least one terminal; providing at least one cavity body element; aligning the cavity body element with the at least one counter-terminal of the printed circuit board; inserting the terminal through an inlet opening in the cavity of the cavity body element; and locking the terminal by means of the primary locking member of the cavity body element. Providing a cavity body element for receiving at least one terminal allows the plugging of the terminal on the corresponding counter terminal of the PCB, and thus a fast and easy conductive connection that is suitable for transferring signal and/or powers. Further, by locking the received terminal, a secure connection can be achieved, since the locking renders the terminal essentially immobile and prevents the terminal from being pulled out of the cavity.

The method further may comprise the following method steps: providing a secondary locking element, wherein the secondary locking element may be pre-installed in a pre-position on the cavity body element; and moving the secondary locking element in the engaging position, after the locking of the terminal by means of the primary locking element. Providing a secondary locking element additionally secures the locking of the terminal. Thus, the risk of an unintentional or accidental releasing can be significantly minimized. Further, by providing a preassembled structure comprising the secondary locking element and the cavity body element, the number of parts to be assembled in the assembly process can be reduced. Thus costs and time can also be reduced.

BRIEF DESCRIPTION OF THE SEVERAL VIEWS OF THE DRAWING

The present invention will now be described, by way of example with reference to the accompanying drawings, in which like reference characters refer to the same parts throughout the different views. The drawings are not necessarily to scale, emphasis instead being placed upon illustrating embodiments of the present invention.

DETAILED DESCRIPTION OF THE INVENTION

Figure 1:
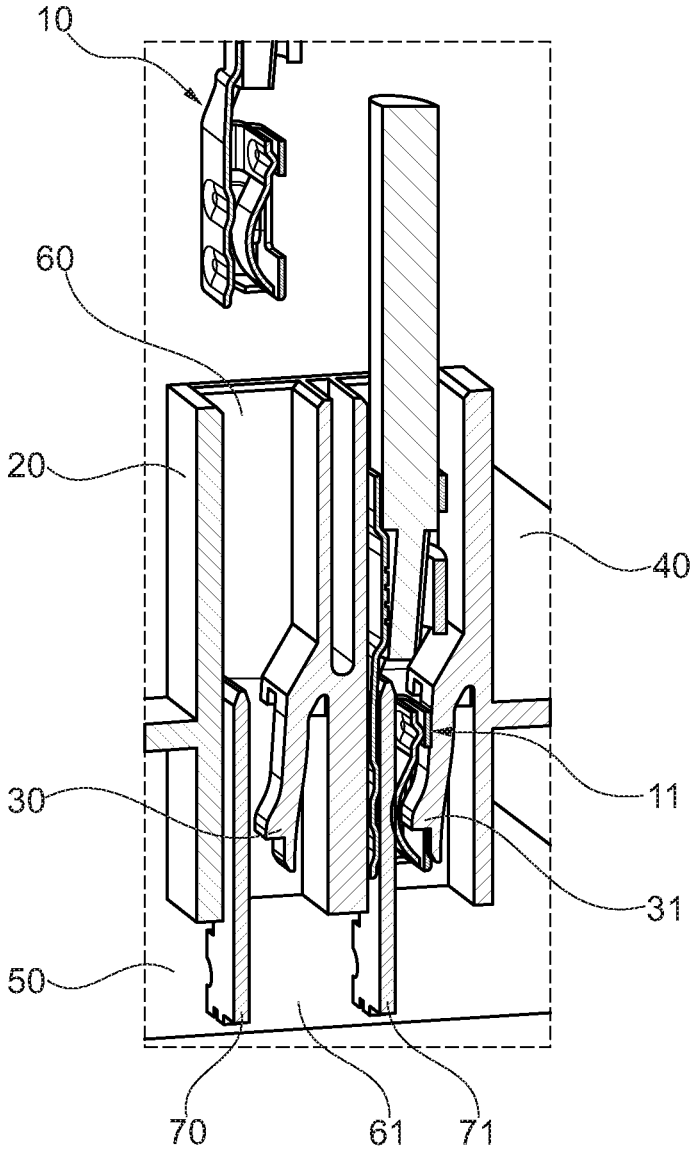
Fig. 1 (Prior Art)
FIG. 1 is a cut view of a prior art hardwired PCB.

FIG. 1 shows a cut view of a prior art hardwired PCB 50. The PCB 50 is provided with pins 70, 71. The pin 71 is connected with a terminal 11 that is secured by means of a latching member 31. The terminal 10 is configured to being connected with the pin 70. Therefore it has to be inserted in the inlet opening 60 of the housing 20 that is part of the housing 40. The housing 40 covers the PCB 50. When inserted, the terminal 10 is secured by means of the latching member 30. As can be seen, the releasing of the terminals 10, 11 is hindered, since the latching members 30, 31 are not accessible. Seen from the inlet opening 60, the latching members 30, 31 are obscured by the terminals 10, 11. Seen from the outlet opening 61, the latching member 30, 31 are obscured by the PCB 50. Thus for releasing the terminals, either a releasing tool has to be used, and/or the PCB has to be removed first, bearing the risk of damaging the PCB.

Figure 2A:
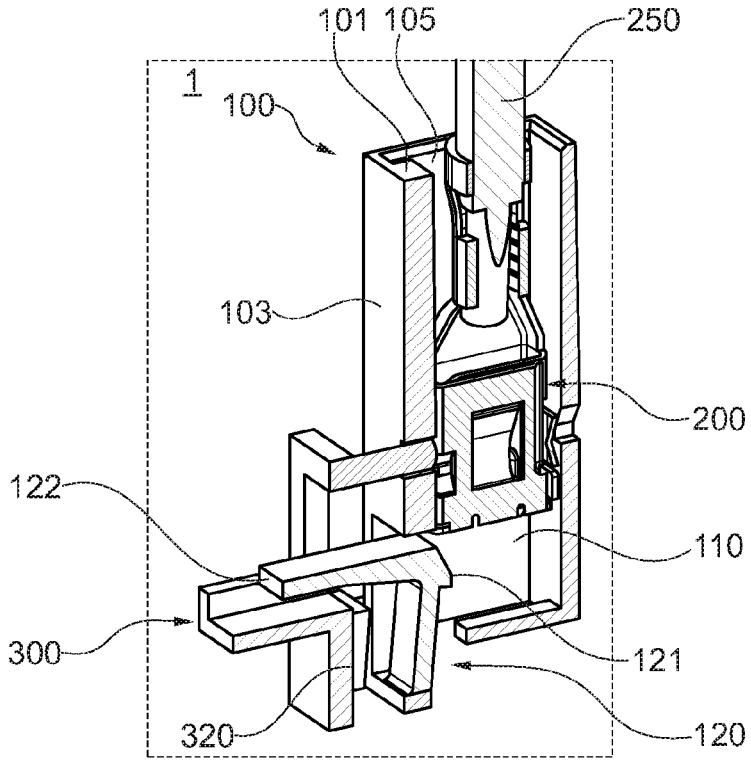
FIGS. 2A-C are cut away views of a cavity body element during the insertion and locking of a terminal according to an embodiment of the invention.
Figure 2B:
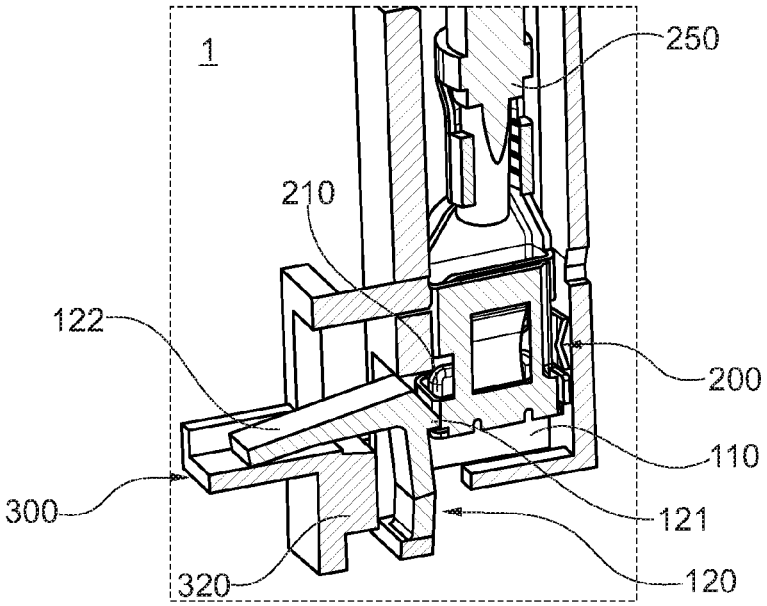
Figure 2C:
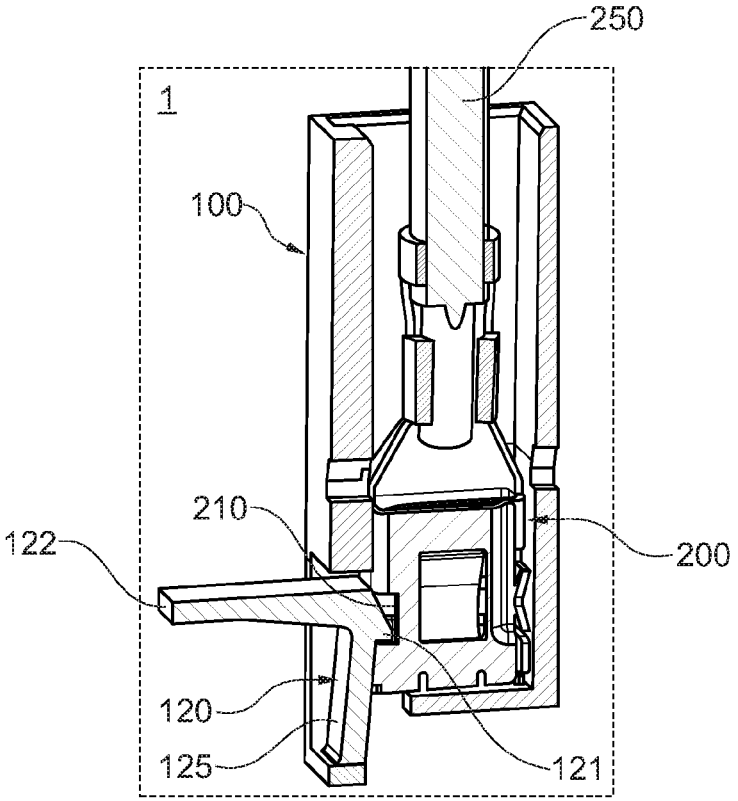

FIGS. 2A-C show cut views of a cavity body element 100 according to an embodiment the invention. As can be seen in FIG. 2A, a terminal 200 arranged on a cable 250 is partially inserted in an inlet opening 105 of the cavity 110 of the cavity body element 100. The inlet opening 105 is provided in a front end 101 of the cavity body element 100. A secondary locking element 300, having a blocking portion 320 is arranged in a pre-position. The primary locking member 120, having a latching protrusion 121 and a releasing arm 122 is elastically arranged, so that the releasing arm 122 protrudes outwardly through a lateral surface 103 of the cavity body element 100. The primary locking member 120 is integrally formed with the cavity body element 100 and provided with some elasticity, such that it will automatically spring back into the position shown in FIGS. 2A and 2C.

FIG. 2B shows the terminal 200 even further inserted into cavity 110. In this point of the insertion process, the terminal 200 passes the primary locking member 120. As indicated by the arrow, the primary locking member is deflected thereby, i.e. moved outwardly, so that the terminal 200 can pass the primary locking member 120, and in particular the latching protrusion 121.

FIG. 2C shows the terminal 200 in its final position. One can see, that it is locked by the primary locking member 120 by means of the latching protrusion 121 of the primary locking member 120 that engages with a latching recess 210 of the terminal 200. As can be seen, the primary locking member 120 has automatically moved back in its initial position, to provide the locking. Thus the terminal 200 is locked in the cavity body element 100.

Figure 3:
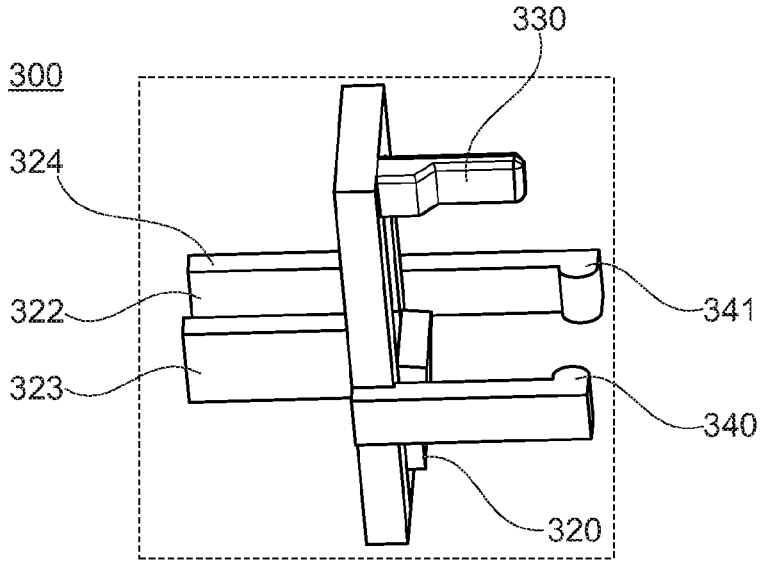
FIG. 3 is a view of a secondary locking element according to an embodiment of the invention.

FIG. 3 shows a secondary locking element 300 according to an embodiment of the invention. This secondary locking element 300 comprises a blocking portion 320 and a protruding arm 322. The protruding arm 322 comprises two sidewalls 323, 324, protruding in the direction of the releasing arm 122, when the secondary locking element 300 is arranged in the engaging position, as can be seen in FIG. 4B. The secondary locking element 300 further comprises a secondary locking member 330, and two latching hooks 340.

Figure 4A:
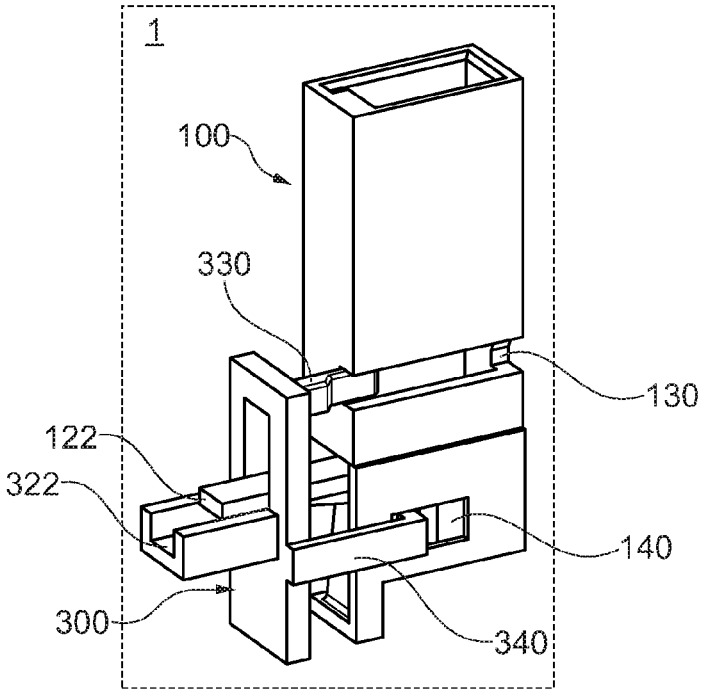
FIGS. 4A, B are views of the secondary locking element of FIG. 3 in a pre-position and in an engaging position according to an embodiment of the invention.
Figure 4B:
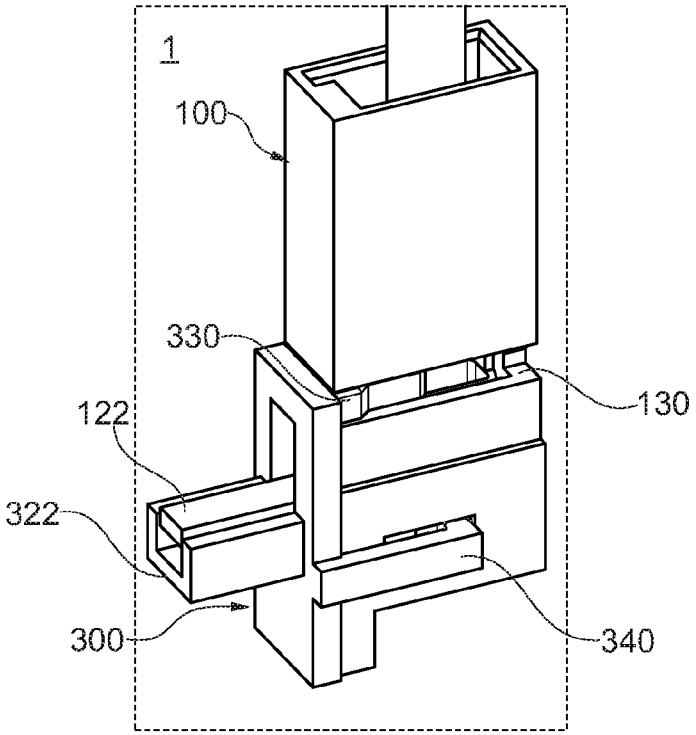

FIGS. 4A and 4B show the secondary locking element 300 of FIG. 3 in a pre-position (FIG. 4A) and in an engaging position (FIG. 4B). In the pre-position of FIG. 4A, the secondary locking element 300 is arranged on the cavity body element 100. This is a preassembled state. In the pre-position, the secondary locking element 300 does not provide any blocking or locking to the terminal 200, so that the terminal 200 can be inserted in the cavity 110 of the cavity body element 100. Further, the secondary locking element is arranged so that the releasing arm 122 is received by the protruding arm 322 of the secondary locking 300. The secondary locking member 330 is received by a guidance groove 130 of the cavity body element 100. Further, the cavity body element 100 provides a latching recess 140 on a lateral surface of the cavity body element 100 that is engageable with the latching hook 340 of the secondary locking element 300. When the secondary locking element 300 is moved from the pre-position, as shown in FIG. 4A in its engaging position, as shown in FIG. 4B, the secondary locking element 300 is at least guided by means of the guidance groove 130. In the engaging position, the latching hook 340 engages the corresponding latching recess 140 and a corresponding guidance groove receives the other latching hook 341 on the opposite side (not visible in the FIGS. 4A and 4B due to the perspective). The blocking and locking functionalities of the secondary locking element 300 can be best seen in FIG. 5.

Figure 5:
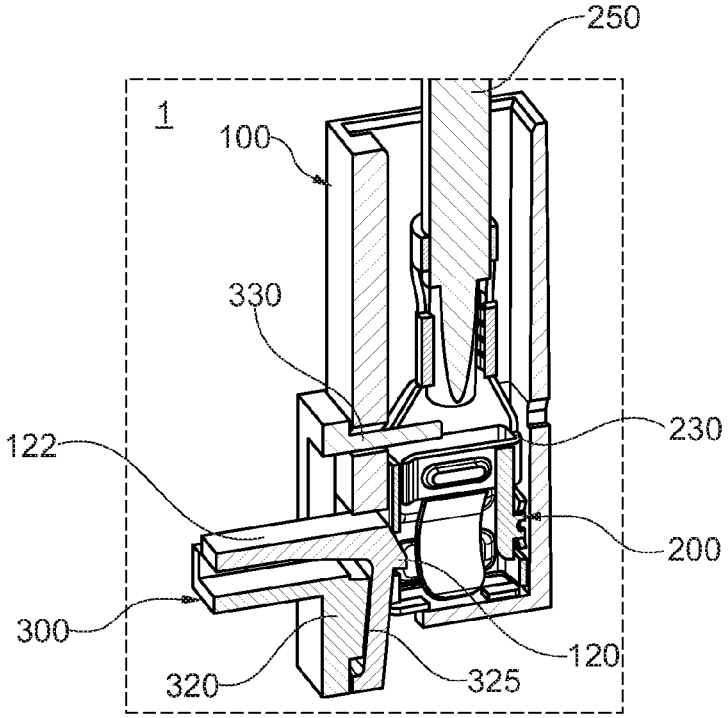
FIG. 5 is a cut away view of the electrical connector system in an engaging position according to an embodiment of the invention.

FIG. 5 shows a cut view of the electrical connector system in the engaging position of the secondary locking element 300, as shown in FIG. 4B. As described with respect to FIG. 2C, the terminal 200 is locked by means of the primary locking member 120 in the cavity 110 of the cavity body element 100. A blocking surface 325 of the blocking portion 320 of the secondary locking element 300 is in contact with an outwardly directed surface 125 (see FIG. 6) of the primary locking member 120. Thus, deflecting the primary locking member 120 outwardly is prevented. Further, in the engaging position, the secondary locking member 330 engages with a secondary locking recess 230 of the terminal 200. Thus, a redundant locking of the terminal 200 is provided.

Figure 6:
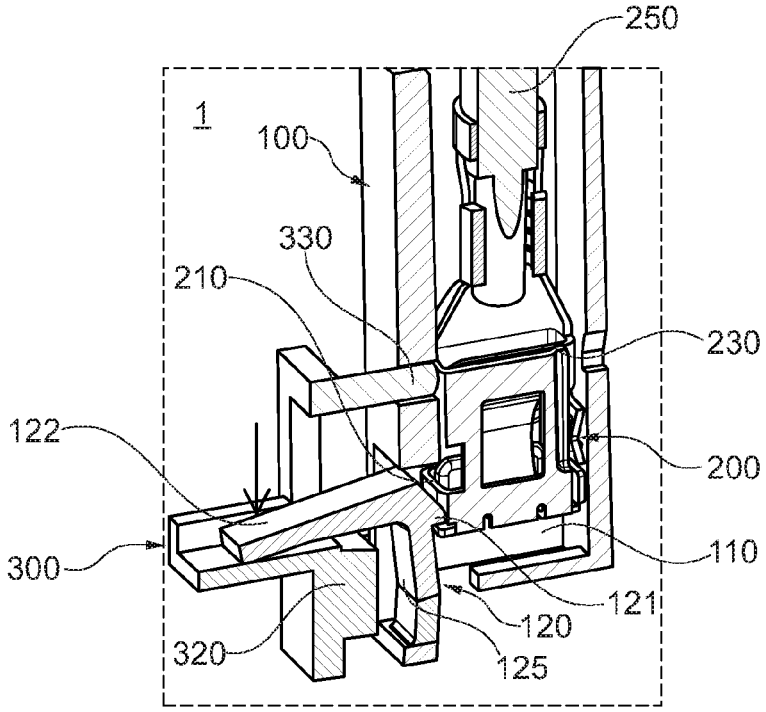
FIG. 6 is a cut away view of the electrical connector system, during releasing the terminal according to an embodiment of the invention.

FIG. 6 shows a cut view of the electrical connector system, during releasing of the terminal 200. As can be seen, the secondary locking element 300 has been moved back in the pre-position, so that the blocking portion 320 is no longer in contact with the outwardly directed surface 125 of the primary locking member 120. By pressing the releasing arm 122, as indicated by the arrow, the primary locking member 120 is moved outwardly. The latching protrusion 121 is disengaged out of the latching recess 210 of the terminal 200. Further, the secondary locking element 300 being back in the pre-position no longer provides locking functionality, i.e. the secondary locking member 330 does no longer engage with the secondary locking recess 230 of the terminal 200. Thus the terminal 200 is released completely, and can be pulled out of the cavity 110.

Figure 7:
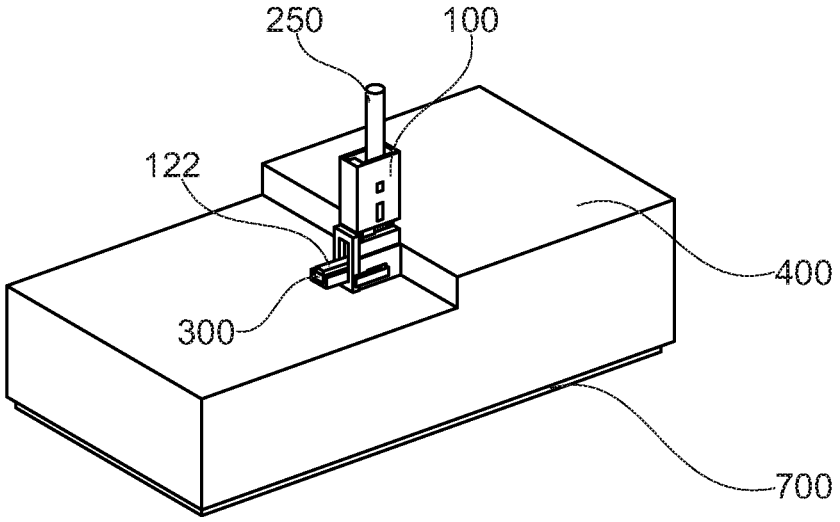
FIG. 7 is a view of an electrical connector system integrated in a housing according to an embodiment of the invention.

FIG. 7 shows an electrical connector system arranged on a housing 400. The housing 400 may cover the PCB 700, to which the cable 250 is connected. A cavity body element 100 is arranged on the housing 400, and may be integrally formed with the housing 400. The secondary locking element 300 is arranged in the engaging position. By removing the secondary locking element 300, or by moving the secondary locking element 300 in the pre-position, the laterally protruding releasing arm 122 becomes operable. As can be seen, the releasing arm 122 is well accessible and can be operated manually. Thus the cable 250 and the respective terminal 200 can be easily disassembled from the PCB 700, covered by the housing 400.

LISTING OF REFERENCE NUMBERS

1 Electrical connector system
10, 11 Terminal (prior art)
20, 40 Housing (prior art)
30, 31 Latching member (prior art)
50, 700 PCB
60 Inlet opening (prior art)
61 Outlet opening (prior art)
70, 71 Pins
100 Cavity body element
101 Front side
103 Lateral surface
105 Inlet opening
110 Cavity
120 Primary locking member
121 Latching protrusion
122 Releasing arm
125 Surface
130 Guidance groove
140 Latching recess
200 Terminal
210 Latching recess
230 Secondary latching recess
250 Wire
300 Secondary locking element
320 Blocking portion
322 Arm
323 First sidewall
324 Second sidewall
325 Blocking surface
330 Secondary locking member
340, 341 Latching hook
400 Housing

I claim:

1. An electrical connector system, comprising:

a terminal configured to be conductively connected to a printed circuit board;

a cavity body element having a cavity and a primary locking member, wherein the cavity extends from a front end to a rear end of the cavity body element and is configured to receive the terminal, wherein the front end is arranged opposite of the rear end, wherein the primary locking member is configured to lock the terminal, and wherein the primary locking member comprises a releasing arm protruding through a lateral surface of the cavity body element; and a secondary locking element, wherein the secondary locking element has a blocking portion connected to the primary locking member to prevent the releasing of the primary locking member in an engaging position of the secondary locking element.

2. The electrical connector system according to claim 1, wherein the primary locking member comprises a latching protrusion configured to latch a corresponding latching recess of the terminal to prevent the terminal from being pulled out of the cavity.

3. The electrical connector system according to claim 1, wherein the primary locking member is configured to be released manually without the need of a releasing tool.

4. The electrical connector system according to claim 1, wherein the primary locking member is configured to be released by pressing the protruding releasing arm.

5. The electrical connector system according to claim 1, wherein the cavity body element provides an audible sound when the primary locking member locks the terminal.

6. The electrical connector system according to claim 1, wherein the cavity body element is integrally formed with a part of a housing covering the printed circuit board.

7. The electrical connector system according to claim 1, wherein a blocking portion of the secondary locking element comprises a blocking surface that contacts an outwardly oriented surface of the primary locking member in the engaging position to prevent an outwardly directed movement of the primary locking member.

8. The electrical connector system according to claim 1, wherein the secondary locking element further comprises a laterally protruding arm that is arranged below the releasing arm of the primary locking member as seen from the front end of the cavity body element, thereby providing an inlet opening for the terminal.

9. The electrical connector system according to claim 1, wherein the secondary locking element further comprises a latching hook configured to latch a corresponding latching recess provided on the lateral surface of the cavity body element to secure the secondary locking element in the engaging position.

10. The electrical connector system according to claim 1, wherein the secondary locking element further comprises a secondary locking member configured to additionally lock the terminal.

11. The electrical connector system according to claim 10, wherein the secondary locking member of the secondary locking element comprises a secondary latching protrusion configured to latch a corresponding secondary latching recess of the terminal to prevent the terminal from being pulled out of the cavity.

12. The electrical connector system according to claim 10, wherein the secondary locking element is moveably arranged on the cavity body element, wherein the secondary locking element is movable form a pre-position into the engaging position, and wherein the secondary locking member of the secondary locking element is guided in a guidance groove to guide the secondary locking element from the pre-position into the engaging position.

13. A method to assemble an electrical connector system, comprising the following steps:

providing a printed circuit board, having a counter-terminal;

providing a terminal;

providing a cavity body element;

aligning the cavity body element with the counter-terminal of the printed circuit board;

inserting the terminal through an inlet opening in a cavity of the cavity body element; and locking the terminal by means of a primary locking member of the cavity body element;

providing a secondary locking element, wherein the secondary locking element is pre-installed in a pre-position on the cavity body element; and moving the secondary locking element in an engaging position, after the locking of the terminal by means of the primary locking member.

* * * * *